United States Patent [19]

Prysby

[11] Patent Number: 4,764,754

[45] Date of Patent: Aug. 16, 1988

[54] FAIL-SAFE ALARM CIRCUIT

[75] Inventor: Daniel G. Prysby, Elk Grove Village, Ill.

[73] Assignee: Honeywell Inc., Minneapolis, Minn.

[21] Appl. No.: 880,625

[22] Filed: Jul. 1, 1986

[51] Int. Cl.[4] ..... G08B 29/00

[52] U.S. Cl. ..... 340/513; 340/506; 340/508

[58] Field of Search ..... 340/513, 514, 506–511, 340/517, 518

[56] References Cited

U.S. PATENT DOCUMENTS

| | | | |
|---|---|---|---|
| 3,212,078 | 10/1962 | Shanahan | 340/513 |
| 3,448,447 | 6/1969 | Tetherow | 340/513 |
| 3,569,964 | 3/1971 | Mande | 340/513 |
| 3,618,081 | 11/1971 | Morrow | 340/513 |
| 3,711,854 | 1/1973 | Reynolds et al. | 340/513 |
| 4,118,694 | 10/1978 | Right | 340/506 |
| 4,249,166 | 2/1981 | Schultz | 340/506 |
| 4,253,091 | 2/1981 | Frydman | 340/506 |
| 4,529,971 | 7/1985 | James | 340/508 |

*Primary Examiner*—Donnie L. Crosland
*Attorney, Agent, or Firm*—Donald J. Lenkszus

[57] ABSTRACT

A fail-safe alarm system includes a device which allows current to flow in only one direction to insure that the supervisory current in an alarm circuit is flowing in the intended direction rather than in a wrong direction caused by a miswiring.

12 Claims, 1 Drawing Sheet

FAIL-SAFE ALARM CIRCUIT

The present invention relates to fail-safe alarm systems, and particularly to those fail-safe alarm systems having the ability to detect miswiring.

BACKGROUND OF THE INVENTION

In many situations, physical variables are monitored and an alarm is sounded when one or more of those variables go outside of preset limits or when a specified event occurs. Examples of such systems are fire alarms and burgular alarms, commonly known jointly as fire and security systems. A critical requirement of such systems is that the alarm circuit be maintained functional at all times. In order to insure that the alarm circuit is always functional, many such alarm circuits include operation in a supervisory mode which checks for open circuits which might be caused by a break in the wiring or a loose connection. A further precaution that is taken in many systems is the use of what is known as a "class A" circuit. In a class A circuit, an open circuit condition will be detectable by the supervisory mode, but will not prevent the alarm from sounding should an alarm condition occur before an open circuit has been repaired.

The use of supervision and class A operation greatly enhances the reliability of such alarm circuits. A problem which still exists, however, lies in the fact that if a circuit is miswired, the supervisory mode may indicate that the circuit is in operational condition, but when an alarm condition occurs, the alarms will fail to be activated.

SUMMARY OF THE INVENTION

In the present invention, a device which allows current to flow in only one direction, such as a diode, is used to insure that the supervisory current in an alarm circuit is flowing in the intended direction, rather than a wrong direction caused by a miswiring.

DETAILED DESCRIPTION OF A PREFERRED EMBODIMENT

Figure 1:
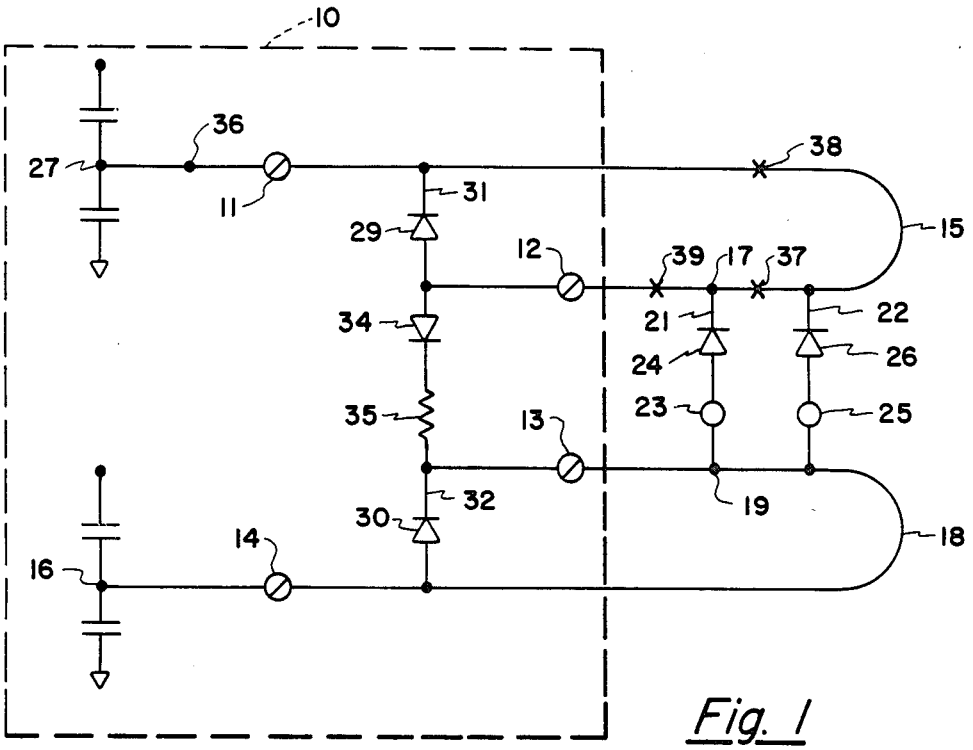
FIG. 1 is a drawing of an embodiment of the alarm circuit of the invention properly wired.

FIG. 1 shows an alarm circuit according to the invention which might be used with a fire and security system or other system requiring an alarm. In a typical fire and security system a portion of the circuit of FIG. 1 would be provided on a central control panel, while other portions would be external to that panel. As shown in FIG. 1, the portion which would typically be on a central control panel is illustrated inside box 10, while the portions external to box 10 would be remote from the central panel.

The central panel circuit 10 includes electrical terminals 11, 12, 13, and 14. Circuit loop 15 has node 16 electrically connected to terminal 11 and node 17 electrically connected to terminal 12. Similarly, circuit loop 18 has node 19 electrically connected to terminal 13 and node 20 electrically connected to terminal 14. Circuit branches 21 and 22 extend between circuit loop 15 and 18. Branch 21 includes annuciator 23 and diode 24, while loop 22 include annunciator 25 and diode 26.

Annunciators 23 and 25 may be any commonly used alarm mechanism, such as bells, horns, lights, or other devices to bring attention to an alarm condition.

When the circuit of FIG. 1 is in supervisory mode, circuit nodes 27 and 28 are electrically biased such that an electrical current flows from node 27 to node 28. When these nodes are thus biased, diodes 29 and 30 prevent electrical current from flowing through circuit branches 31 and 32, respectively. Thus, an electrical current will flow from node 27 through loop 15 to terminal 12 through circuit branch 33 including diode 34 and load resistor 35 through loop 18 to terminal 28. Means to detect current through the supervision circuit, not shown, is electrically connected to terminal 36 to determine whether current is flowing through the circuit. An open circuit condition anywhere along the pathway will be detected and the central control panel will give an appropriate open circuit signal to an operator.

When an alarm condition exists, the polarity of the circuit between nodes 27 and 28 is reversed. At that time, an electrical current will run from node 28 through loop 18 to circuit branches 21 and 22. Because diodes 24 and 26 are now forward biased, electrical current will flow through branches 21 an 22 causing annunciators 23 and 25 to signal an alarm condition. The circuit will then be completed through loop 15 to node 27. The alarm function will not be hampered by an open circuit condition. For example, an open circuit condition at point 37 would still allow the electrical current flowing through branches 21 and 22 a closed path through terminal 12 and branch 31 of the circuit. Similarly, an open circuit condition at point 38 would allow the circuit to be closed through terminal 11 to node 27. If an open circuit condition occurred at point 39, the circuit, including branch 21, would be closed through terminal 12 while the circuit, including branch 22, would be closed through terminal 11. Those skilled in the art will readily see that open circuits on loop 18 would not prevent the alarm from sounding for similar reasons.

Figure 2:
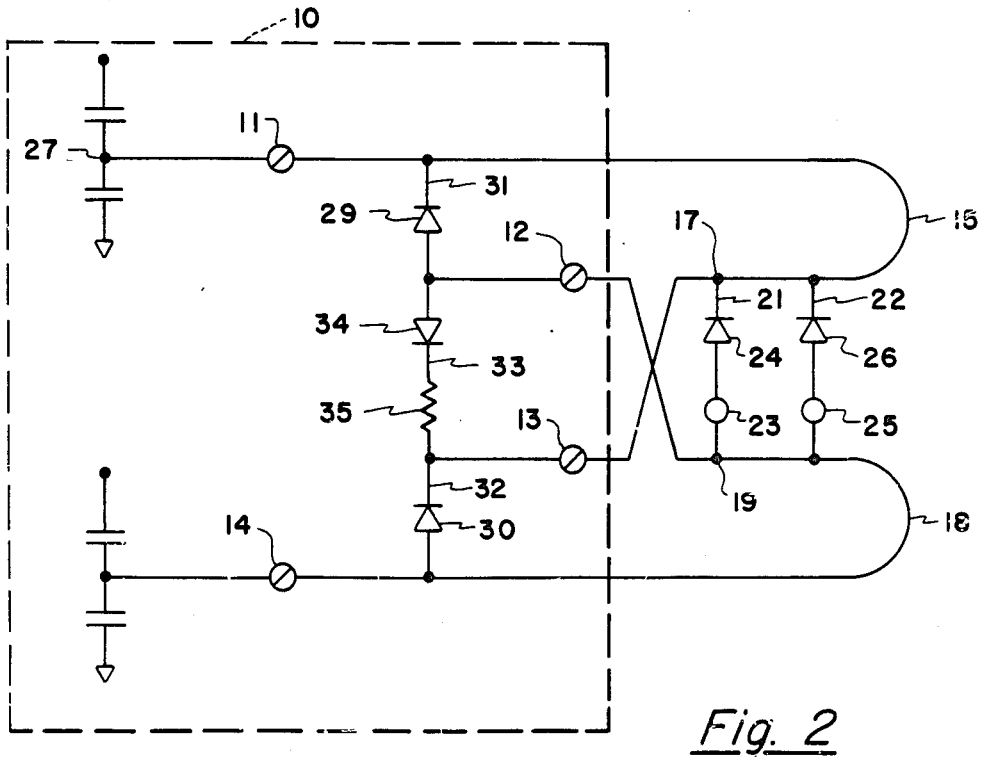
FIG. 2 is a drawing of the alarm circuit of the invention when it has been miswired.

Turning now to FIG. 2, the circuit of FIG. 1 is illustrated, except that nodes 17 and 19 have been misconnected to terminals 13 and 12, respectively. In a conventional circuit, i.e., one without diode 34, the supervisory current would flow through branch 33 in a reverse direction showing no defect in the circuit. When an alarm circuit resulted, however, loop 18 would be short circuited to terminal 12, thus bypassing annunciators 23 and 25.

In the present invention, however, diode 34 blocks flow of the current through branch 33 in the supervisory mode if the system is miswired as shown in FIG. 2. Thus, if the system is miswired, the supervisory mode will immediately detect the fact and indicate that a problem exists to the operator. It then may be rewired in the correct fashion. Similarly if nodes 16 and 20 are reversed so that 20 is electrcially connected to terminal 11 and node 16 is electrically connected to terminal 14, diode 34 likewise prevents current flow through branch 33, thus indicating the fault.

The embodiments of the present invention in which an exclusive property or right is claimed are defined as follows:

1. An alarm circuit including:

first and second electrical circuit loops; first connecting means for electrically connecting said first and second electrical circuit loops, said first connecting means including annunciator means and including first unidirectional conducting means for insuring that electrical current pass through said first connecting means only from said second loop to said first loop; and second connecting means for electrically connecting said first and second electrical circuit loop, said second connecting means including second unidirectional conducting means for insuring that supervisory electrical current flows through said second connecting means only from said first electrical loop to said second electrical circuit loop such that if said first and second electrical circuit loops are miswired supervisory electrical current will not flow and the miswiring will be detected.

2. The alarm circuit of claim 1 wherein said second unidirectional current means includes an electrical diode.

3. The alarm circuit of claim 1 wherein said second electrical connecting means further includes an electrical resistor means.

4. The alarm circuit of claim 2 wherein said second unidirectional current means includes an electrical diode means.

5. A central control panel for a monitoring system including an output system for an alarm circuit, said output system comprising:

first, second, third, and fourth terminal means for connection to an external alarm circuit;

first connecting means for electrically connecting said first and second terminal means;

second connecting means for electrically connecting said second and third terminal means, said second connecting means including unidirectional current means for insuring that supervisory electrical current can flow through said second connecting means only from said second terminal means and said third terminal means whereby if said third and fourth connecting means are misconnected said misconnection will be detected by interruptions of said supervisory electrical current; and third connecting means for electrically connecting said third and fourth terminal means.

6. The central control panel of claim 5 wherein said second connecting means unidirectional current means includes an electrical diode.

7. The central control panel of claim 5 wherein said second connecting means includes an electrical resistor means.

8. The central control panel of claim 7 wherein said second connecting means unidirectional current means includes an electrical diode.

9. The central control panel of claim 5 wherein:

said first connecting means includes unidirectional current means for insuring that electrical current can flow through said first connecting means only from said second terminal means to said first terminal means; and said third connecting means includes unidirectional current means for insuring that electrical current flows through said third connecting means only from said fourth terminal means to said third terminal means.

10. The central control panel of claim 9 wherein each of said unidirectional current means includes a diode means.

11. The central control panel of claim 9 wherein said second connecting means includes an electrical resistor means.

12. The central control panel of claim 11 wherein each of said unidirectional current means includes a diode means.

* * * * *